United States Patent [19]

Wedel

[11] Patent Number: 4,876,803

[45] Date of Patent: Oct. 31, 1989

[54] DRYER APPARATUS FOR DRYING A WEB

[75] Inventor: Gregory L. Wedel, Beloit, Wis.

[73] Assignee: Beloit Corporation, Beloit, Wis.

[21] Appl. No.: 223,186

[22] Filed: Jul. 22, 1988

Related U.S. Application Data

[63] Continuation-in-part of Ser. No. 14,569, Feb. 13, 1987.

[51] Int. Cl.[4] ..... F26B 11/02

[52] U.S. Cl. ..... 34/117; 34/116; 34/120

[58] Field of Search ..... 34/116, 115, 117, 156, 34/158, 23

[56] References Cited

U.S. PATENT DOCUMENTS 4,441,263 4/1984 Vedenpää ..... 34/115
4,510,698 4/1985 Ely ..... 34/117

FOREIGN PATENT DOCUMENTS 2813933 10/1978 Fed. Rep. of Germany ..... 34/115

*Primary Examiner*—Henry A. Bennet
*Assistant Examiner*—John Sollecito
*Attorney, Agent, or Firm*—Dirk J. Veneman; Raymond Campbell; David J. Archer

[57] ABSTRACT

A dryer apparatus is disclosed for drying a web extending through a dryer section of a paper machine. The apparatus includes a first and a second dryer. A dryer felt movably extends around the dryers such that the web is disposed between the dryers and the felt for drying the web. A vacuum transfer roll is disposed downstream relative to the first dryer and upstream relative to the second dryer such that the web and the felt extend around the transfer roll so that the felt is disposed between the web and the transfer roll when the web and the felt move around the transfer roll. A seal device extends between the first and the second dryers for reducing a flow of air between the first and the second dryers into a pocket defined by the transfer roll and the felt extending between the dryers and the transfer roll. The transfer roll includes a perforate shell connected to a source of partial vacuum such that in use of the apparatus, a partial vacuum is generated within the shell, for inducing a further partial vacuum within the pocket so that air flows in a direction from the web towards the felt for urging the web into close conformity with the felt during movement of the web around the transfer roll and also during movement of the web between the dryers and the transfer roll.

8 Claims, 8 Drawing Sheets

FIG. 1
PRIOR ART
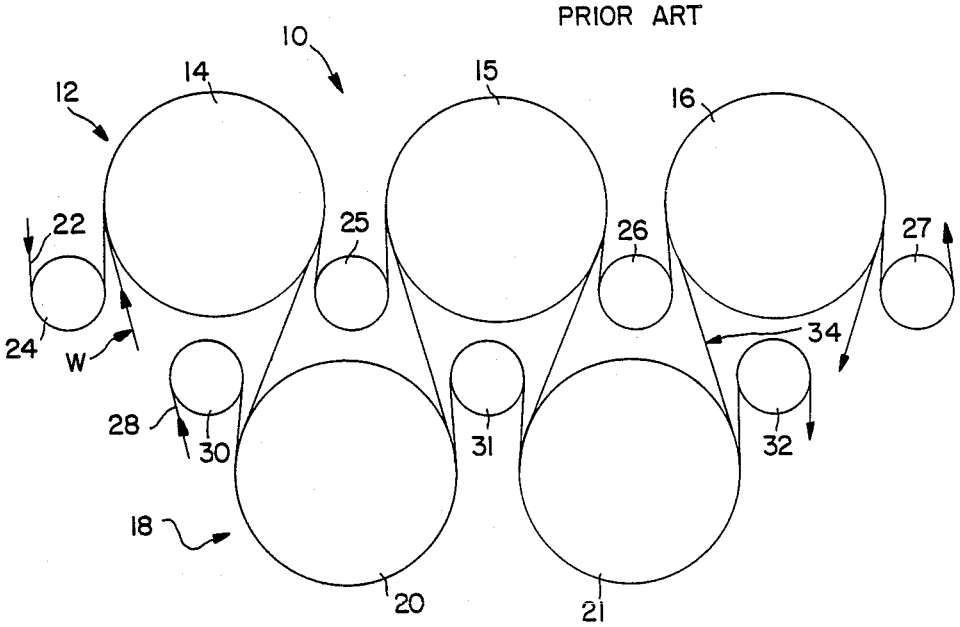
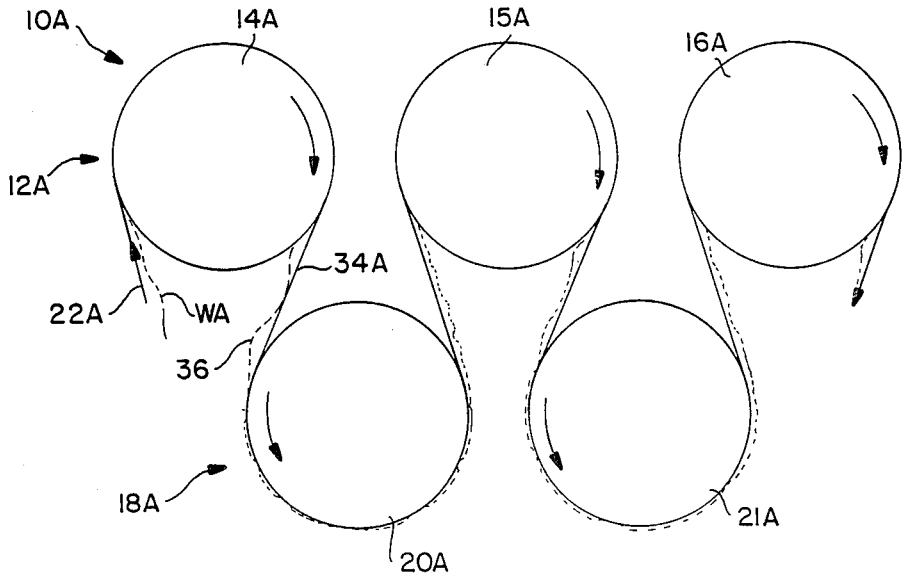
FIG. 2
PRIOR ART

FIG. 7
PRIOR ART
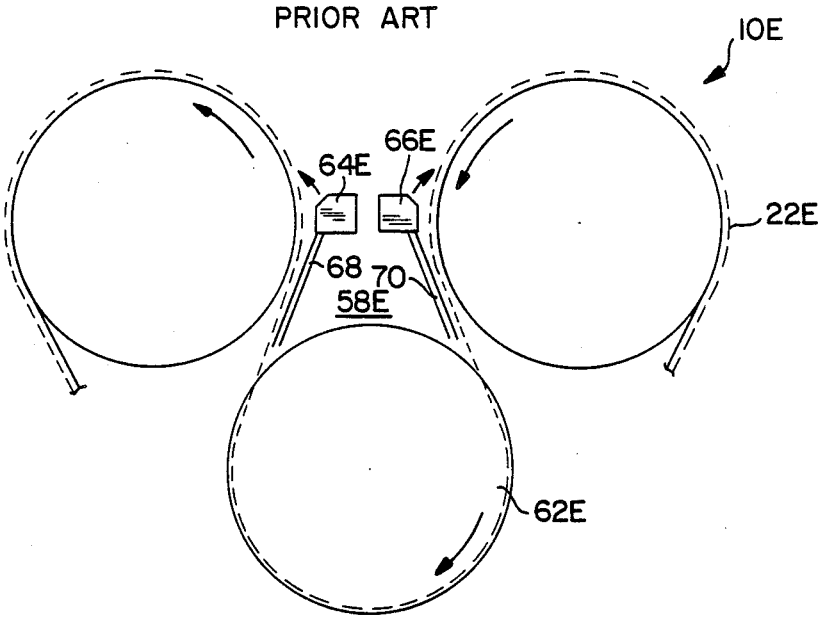
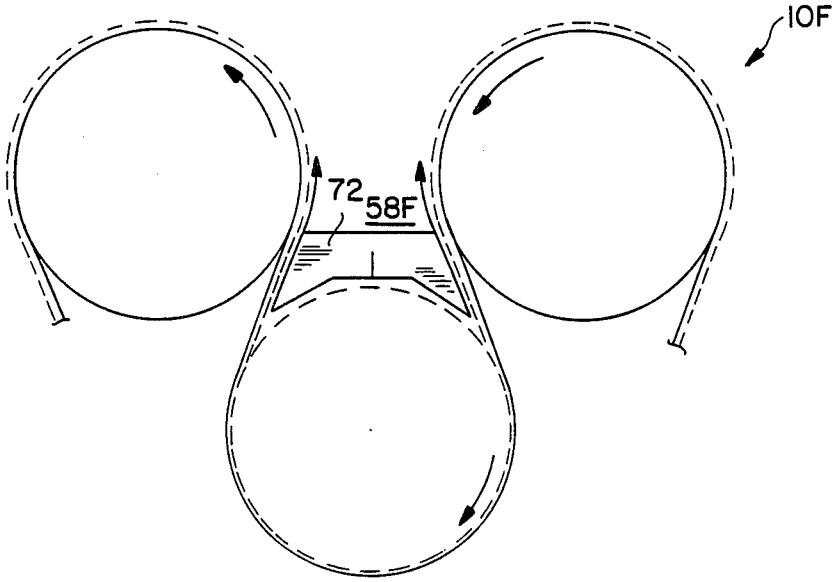
FIG. 8
PRIOR ART

DRYER APPARATUS FOR DRYING A WEB

CROSS REFERENCE TO RELATED APPLICATIONS

This application is a continuation in part of co-pending patent application Ser. No. 14,569 filed Feb. 13, 1987. All the disclosure of Ser. No. 014,569 is incorporated herein by reference.

BACKGROUND OF THE INVENTION

1. Field of the Invention

This invention relates to a dryer apparatus for drying a web extending through a dryer section of a paper machine. More specifically, this invention relates to a TOTAL BELRUN dryer apparatus. TOTAL BELRUN is a registered Trademark of Beloit Corporation.

2. Information Disclosure Statement

In the paper drying art, one of the primary problems with the high speed operation of a paper dryer section is sheet flutter which occurs when an unsupported web extends between successive dryers in a dryer section.

By the introduction of the so-called "single felt" configuration, sheet flutter was minimized. Such "single felt" configuration included an upper and a lower tier of dryers with the web and dryer felt extending contiguously around upper and lower dryers of the respective tiers. Although the "single felt" configuration avoided the problems associated with an unsupported web, such "single felt" or "serpentine" configuration introduced a further problem in that during passage of the web and felt around the dryers of the lower tier, the dryer felt was disposed between the respective dryers and the web. Therefore, the drying capability of the lower tier of dryers was inhibited. Additionally, in the "single felt" arrangement, the web had a tendency to separate from the felt during travel of the web towards, around and away from the dryers of the lower tier. Furthermore, initial threading of the web through a "single felt" dryer section was relatively difficult.

The aforementioned problems of "single felt" dryer sections was overcome by the provision of the TOTAL BELRUN arrangement which is the subject of co-pending patent application 014,569 filed Feb. 13, 1987. In the TOTAL BELRUN configuration, the lower tier of dryers in the "single felt" arrangement are replaced by vacuum transfer rolls. The vacuum transfer rolls avoid the necessity for a redundant lower tier of dryers. Furthermore, due to the application of vacuum, the tendency of the web to separate from the dryer felt during movement around the transfer roll is inhibited. Also, the draw between the single tier of dryers and the transfer roll is reduced thereby enhancing the stability of the web relative to the dryer felt. Additionally, by the provision of such vacuum rolls, initial threading of the web is facilitated.

Recent installations of the TOTAL BELRUN concept have indicated that such concept can be extended to include a large number of dryers without the introduction of any adverse effect on the web runnability. Such runnability is attained because the vacuum rolls are capable of conveying the web along the felt-supported spans without the need for sheet tension or section draw points.

Nevertheless, one potential problem with the TOTAL BELRUN system is that there remains a short draw length between the dryers and the effective vacuum zones of the intermediate vacuum transfer rolls.

Although the web will generally be conveyed through the short draws with little or no separation from the felt, it has been observed during machine upsets that the edges of the web may separate by as much as one inch from the felt. The aforementioned upsets are typically caused by short periods of time in which the basis weight or grammage of the web and the moisture content of the web are nonuniform. The release characteristics of the web edges from the dryer surfaces during the aforementioned periods occasionally cause the web to be pulled from intimate contact with the felt. The web is then subjected to the disturbing influences of local air currents and centrifugal forces. The result of such disturbances can be undesirable wrinkling of the sheet and in extreme cases web breakage.

In U.S. Pat. No. 3,868,780 to Soininen, the dryers are arranged in such a configuration as to define an enclosure from which air is evacuated. The resultant partial vacuum generates a partial vacuum within perforate transfer rolls thereby drawing the web towards the dryer felt during transit of the web and felt around such perforate rolls. However, the provision of the aforementioned evacuated enclosure involves various sealing problems relative to the edges of the web and complications relative to access to the various dryers of the dryer section.

Other attempts to reduce edge flutter of the web relative to conventional "single felt" arrangements are disclosed in U.S. Pat. No. 4,502,231 to Fissmann et al, dated Mar. 5, 1985, U.S. Pat. No. 4,359,828 to Thomas dated Nov. 23, 1982 and U.S. Pat. No. 4,553,340 to Petersson dated Nov. 19, 1985. However, the aforementioned patents which all relate to "single felt" arrangements require full-width air nozzles to induce vacuum adjacent to the felt on the opposite side relative to the web in the felt supported draws. The nozzles require large quantities of air and the associated power requirements for the fans can be relatively high. Such boxes further necessitate the provision of a large space between adjacent dryers in order to accommodate boxes of adequate structural strength. Such large spaces increase the machine direction length of the dryer section and increase the cost of the building required to house such a dryer section. Additionally, dust and paper debris can accumulate on the aforementioned boxes and interfere with the action of the air jets.

Also, the vacuum induced by the aforementioned boxes causes deflection of the felt towards the boxes and, in severe cases, the felt will contact the box and cause excessive felt wear. Because of the aforementioned wear condition, the vacuum levels must be maintained at a relatively low level.

Additionally, the vacuum induced by the aforementioned prior art boxes must prevent the web from separating from the fabric as the web approaches the felt roll converging nip and as the web wraps the roll. The aforementioned nip and wrapping locations are the most critical locations. However, in the prior art no vacuum is applied directly at these critical locations.

U.S. Pat. No. 4,441,263 to Vedenpaa includes a vacuum box in association with a grooved roll so that the vacuum can extend further into the aforementioned critical locations. However, the vacuum applied as disclosed in 4,441,263 is highest in the pocket area above the grooved roll and lowest in the aforementioned converging nip location and where the web wraps the grooved roll.

The aforementioned problems are solved by utilizing vacuum rolls as taught in the aforementioned U.S. Ser. No. 014,569 instead of using grooved rolls or dryers in the intermediate position. Such vacuum rolls include seals for sealing the area between the dryers above the associated vacuum roll. In the present invention, rather than drawing the vacuum from the pocket area as taught in U.S. Pat. No. 4,441,263, the vacuum is drawn from the inside of the perforate vacuum roll. In this manner, the maximum vacuum is produced in the critical locations, including the area where the web wraps the vacuum roll. Furthermore, a lesser vacuum is applied at the critical location where the web approaches the vacuum roll and where the web leaves the roll. Additionally, such vacuum generates a minimal vacuum level within the pocket for drawing the web into close conformity with the dryer felt during transit between the dryers and the transfer roll.

More particularly, the air which flows into the roll encounters a pressure drop across the perforate shell of the transfer roll so that the vacuum level in the enclosed pocket is less than the vacuum level applied at the aforementioned critical locations.

Additionally, by locating the vacuum roll close to the dryers, the felt-supported draw length is minimized. Such minimization of the draw length not only reduces the tendency for the web to separate from the fabric, but also reduces the amount of fabric deflection which will occur for a given vacuum level.

Also, by the provision of the present invention, the stationary internal center shaft and relatively complex sealing arrangements associated with the vacuum roll of the aforementioned Ser. No. 014,569 is avoided. Pocket seals are included in the present invention for restricting the vacuum roll from drawing in excessive volumes of air and to extend the vacuum to the felt-supported draw lengths.

The stationary internal roll components can additionally be replaced by various divider plates or orifice plates which assist in concentrating the vacuum drawn out of the vacuum roll to compartments disposed adjacent to the front and back of the vacuum roll where the web is most susceptible to separation from the felt.

Accordingly, it is a primary object of the present invention to provide a dryer apparatus which overcomes the aforementioned inadequacies of the prior art dryer sections and which provides a significant contribution to the paper web drying art.

Another object of the present invention is the provision of a dryer apparatus in which the transfer rolls can be constructed without any internal stationary center shafts.

Another object of the present invention is the provision of a dryer apparatus in which the dryer pockets can be enclosed with sealing plates or boxes.

Other objects and advantages of the present invention will be apparent to those skilled in the art by a consideration of the detailed description contained hereinafter taken in conjunction with the annexed drawings and from the appended claims.

SUMMARY OF THE INVENTION

The present invention relates to a dryer apparatus and method for drying a web extending through a dryer section of a paper machine. The apparatus includes a first dryer of the dryer section and a dryer felt movably extending around the first dryer such that the web is disposed between the first dryer and the felt for drying the web. A second dryer is disposed downstream relative to the first dryer with the web and the felt extending around the second dryer such that the web is disposed between the second dryer and the felt for further drying the web. A vacuum transfer means is disposed downstream relative to the first dryer and upstream relative to the second dryer such that the web and the felt extend around the transfer means so that the felt is disposed between the web and the transfer means when the web and the felt move around the transfer means. Sealing means extend between the first and the second dryers for reducing a flow of air between the first and the second dryers into a pocket defined by the transfer means and the felt extending between the dryers and transfer means. The transfer means includes a perforate shell, the shell being connected to a source of partial vacuum such that in use of the apparatus, a partial vacuum is generated within the shell, such partial vacuum inducing through the perforate shell, a further partial vacuum within the pocket so that air flows in a direction from the web towards the felt for urging the web into close conformity with the felt during movement of the web around the transfer means and also during movement of the web between the dryers and the transfer means.

In a more specific embodiment of the present invention, the transfer means is a vacuum transfer roll and the sealing means includes a wedge-shaped box which is disposed within and which conforms to the shape of the pocket such that the further vacuum is generated within the pocket and externally relative to the box.

The sealing means also includes a first seal which extends from the box, the first seal sealingly cooperating with the felt as the felt moves away from the first dryer. The sealing means also includes a second seal which extends from the box, the second seal sealingly cooperating with the felt as the felt begins to move around the second dryer. The seals maintain the further partial vacuum for urging the web towards the felt between the dryers and the transfer means.

The perforate shell is rotatably connected to the source of partial vacuum and the transfer roll also includes a stationary duct having a first and a second end. The duct is disposed within the rotatable shell and the duct defines a plurality of apertures between the first and the second ends thereof. The duct is connected to the source of partial vacuum such that in use of the apparatus, the partial vacuum within the duct induces the partial vacuum within a cavity defined between the shell and the duct.

A gasket extends from the duct to the shell for dividing the cavity into a first and a second portion. The first portion is disposed adjacent to the felt and the web as the felt and the web extend around the transfer roll.

The gasket extends partially around the duct adjacent to the first and second ends of the duct. More specifically, the gasket extends from a first angular location disposed upstream relative to the convergence of the felt and the transfer roll to a second angular location disposed downstream relative to the divergence of the felt and the transfer roll. The gasket extends axially along the first location from the first to the second end of the duct. The gasket also extends axially along the second location from the first to the second end of the duct. The arrangement is such that in use of the apparatus, a maximum vacuum level is maintained within the first portion, a minimum vacuum level is maintained within the pocket and an intermediate vacuum level is maintained within the second portion which is disposed adjacent to the areas of convergence and divergence of the felt and transfer roll. The maximum vacuum level maintains the web in close conformity with the felt as the web and the felt extend around the transfer roll. The intermediate vacuum level is operative adjacent to the convergence and the divergence of the felt relative to the transfer roll. Furthermore, the minimum vacuum level is operative for urging the web towards the felt during movement of the web between the dryers and the transfer roll.

In an alternative embodiment of the present invention, the shell has a first and a second extremity. The shell also includes first and second baffles which are disposed axially relative to each other within the perforate shell for defining a first and a second chamber within the perforate shell. The first and the second chambers are disposed respectively adjacent to the first and second extremities of the perforate shell. An air flow conduit extends from the first to the second baffle such that the first and second chambers are in fluid communication with each other. Valve means are disposed within the conduit for regulating the flow of air within the conduit between the first and the second chambers. An intermediate chamber is defined by the perforate shell, the baffles and the conduit. The conduit defines a plurality of holes for permitting flow of air from within the intermediate chamber into the conduit. The arrangement is such that in use of the apparatus, when the perforate shell is connected to a source of partial vacuum and when the valve means is closed, the greatest vacuum is generated within the first chamber for facilitating threading of a tail of the web. When the valve means is open, an equal vacuum is generated within the first and the second chambers for urging the lateral edges of the web into close conformity with the felt as the web and the felt extend around the transfer roll. The aforementioned equal vacuum is less than the aforementioned greatest vacuum. Such partial vacuum also generates a minimal vacuum level within the intermediate chamber for generating a minimal vacuum within the pocket.

In yet another embodiment of the present invention, a perforate shell has first and second extremities with the extremities of the shell being connected respectively to a source of partial vacuum. The transfer roll includes a first and a second orifice plate which are spaced axially relative to each other within the perforate shell for defining a threading cavity and an edge cavity respectively. A control valve controls the flow of air from the edge cavity such that when the control valve is closed, air flows into the perforate shell with a high vacuum being generated within the threading chamber due to the first orifice plate for facilitating threading of the tail of the web. When the control valve is open, air flows into the perforate shell generating an intermediate vacuum within the threading chamber and the edge chamber. The intermediate vacuum is higher than the vacuum within the perforate shell between the orifice plates due to the provision of the orifice plates so that fluttering of the edges of the web relative to the felt as the web extends around the transfer roll is inhibited due to the aforementioned intermediate vacuum. The intermediate vacuum is less than the high vacuum.

Many modifications and variations of the present invention will be apparent to those skilled in the art. However, such modifications and variations are included within the present invention and may be made without departing from the spirit and scope of the present invention as defined by the appended claims.

BRIEF DESCRIPTION OF THE DRAWINGS

FIG. 1 is a side-elevational view of a prior art double felted dryer section;

FIG. 2 is a side-elevational view of a prior art single felted dryer section;

FIG. 7 and FIG. 8 are side-elevational views of prior art arrangements shown in U.S. Pat. No. 4,553,340 showing full width blow boxes disposed within a pocket;

Similar reference characters refer to similar parts throughout the various embodiments of the present invention.

DETAILED DESCRIPTION OF THE DRAWINGS

Figure 3:
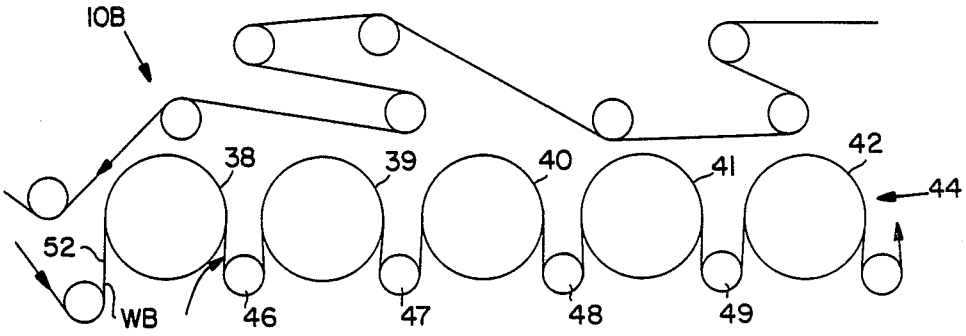
FIG. 3 is a side-elevational view of a TOTAL BELRUN configuration described in co-pending patent application 014,569.

FIG. 1 is a side-elevational view of a typical prior art double felted dryer section generally designated 10. The dryer section 10 includes an upper tier generally designated 12 of dryers 14, 15, and 16. A lower tier generally designated 18 includes dryers 20 and 21. A web W extends successively between dryers 14 and 20 of the upper and lower tier 12 and 18 respectively. An upper felt 22 extends alternately around transfer rolls 24, 25, 26 and 27 and dryers 14, 15 and 16 of the upper tier. A lower felt 28 extends alternately around transfer rolls 30, 31 and 32 and dryers 20 and 21 of the lower tier 18. Consequently, the web W is unsupported as indicated by 34 during transit between the dryers of the upper and lower tiers 12 and 18 respectively.

FIG. 2 is a side-elevational view of a "single felt" or serpentine dryer section generally designated 10A which includes dryers 14A, 15A and 16A of an upper tier generally designated 12A. The dryer section 10A also includes dryers 20A and 21A of a lower tier generally designated 18A. The web WA and felt 22A extend contiguously relative to each other in sinusoidal configuration around successive dryers of the upper and lower tiers 12A and 18A respectively so that the web WA is supported by the felt 22A during transit between dryers of the upper and lower tiers 12A and 18A as indicated by 34A. Although the web WA is supported throughout the various draws 34A, the heating effect of the lower dryers 20A and 21A is greatly reduced because the felt 22A is disposed between the web WA and the dryers 20A and 21A. Also, as shown at 36, there exists a tendency for the web WA to flutter relative to the lower dryers 20A and 21A in the absence of positive restraint of the web WA during transit around the lower dryers 20A and 21A.

FIG. 3 is a side-elevational view of a dryer section generally designated 10B known as the TOTAL BELRUN and as disclosed in co-pending patent application 014,569 filed Feb. 13, 1987. The dryer section 10B includes a plurality of dryers 38, 39, 40, 41 and 42 arranged as a single tier generally designated 44 with vacuum transfer rolls 46, 47, 48 and 49 interposed between adjacent dryers. The web and felt WB and 52 respectively extend contiguously and successively around the dryers 38 to 42 and rolls 46 to 49 with the vacuum rolls supplying a positive restraint to the web WB during movement of the web WB around the respective rolls 46 to 49.

Figure 4:
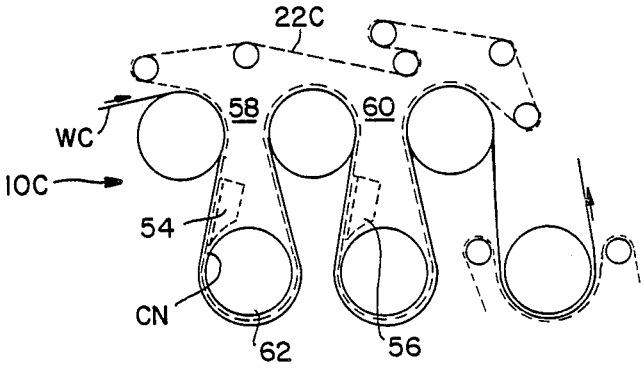
FIG. 4 PRIOR ART
FIG. 4 is a prior art single felt arrangement shown in U.S. Pat. No. 4,502,231 including a blow box.

FIG. 4 is a side-elevational view of a prior art single felt dryer section generally designated 10C including blow boxes 54 and 56 disposed within respective pockets 58 and 60 for reducing the buildup of pressure at the converging nip CN of the dryer felt 22C and the lower dryer 62 for reducing flutter of the web WC relative to the dryer felt 22C at this location CN.

Figure 5:
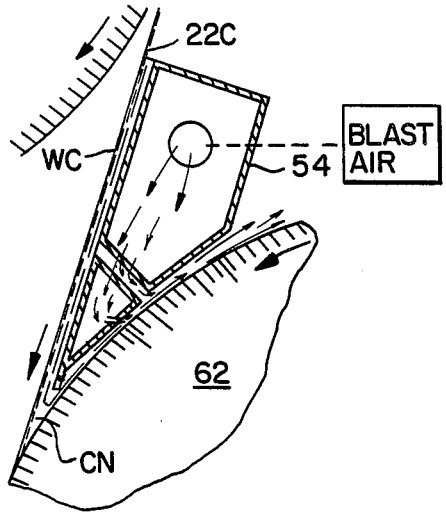
FIG. 5 PRIOR ART
FIG. 5 is an enlarged view of the blow box shown in FIG. 4.

FIG. 5 is an enlarged sectional view of the blow box 54 shown in FIG. 4 for reducing the air pressure at the aforementioned converging nip CN of the web WC and felt 22C relative to the dryer 62.

Figure 6:
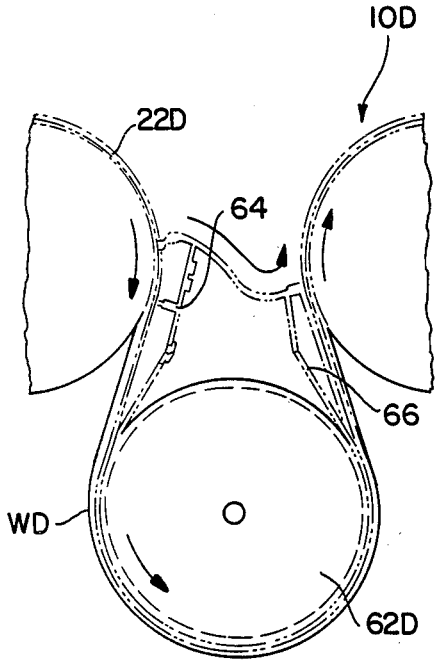
FIG. 6 PRIOR ART
FIG. 6 is a side-elevational view of a prior art arrangement shown in U.S. Pat. No. 4,359,828 showing a full width blow box.

FIG. 6 is a side-elevational view of a dryer section generally designated 10D of a prior art arrangement shown in U.S. Pat. No. 4,359,828. Sealed blow boxes 64 and 66 are designed to draw the web WD into conformity with the dryer felt 22D during movement around the lower dryer 62D.

FIG. 7 and 8 are side-elevational views of dryer sections 10E and 10F respectively of prior art arrangements shown in U.S. Pat. No. 4,553,340. FIG. 7 shows blow boxes 64E and 66E with foils 68 and 70 extending into a pocket 58E defined by the felt 22E and the lower dryer 62E.

FIG. 8 shows a blow box 72 of wedge-shaped configuration disposed within a pocket 58F for blowing air out of the pocket 58F.

Figure 9:
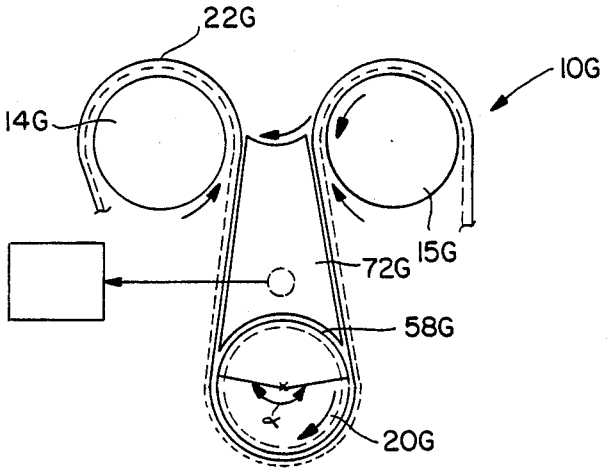
FIG. 9 PRIOR ART
FIGS. 9 and 10 are side-elevational views of two prior art embodiments shown in U.S. Pat. No. 4,441,263 including vacuum boxes in association with grooved rolls.

FIG. 9 is a side-elevational view of a prior art dryer section generally designated 10G including a wedge-shaped vacuum box 72G disposed within a pocket 58G defined by a dryer felt 22G extending between upper dryers 14G and 15G and a grooved lower dryer 20G.

Figure 10:
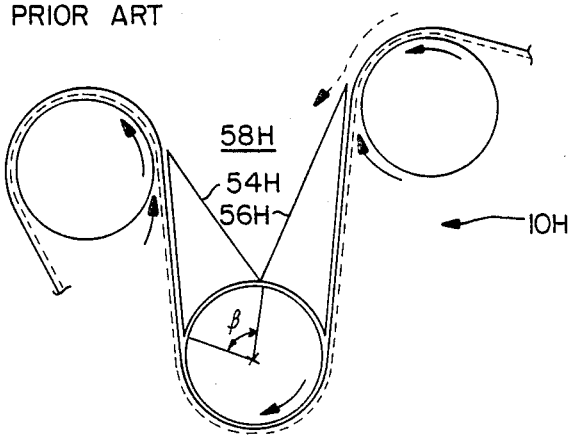
FIG. 10 PRIOR ART

FIG. 10 is a side-elevational view of another dryer section generally designated 10H of U.S. Pat. No. 4,441,263 including a first and second vacuum box 54H and 56H respectively disposed within the pocket 58H.

Figure 11:
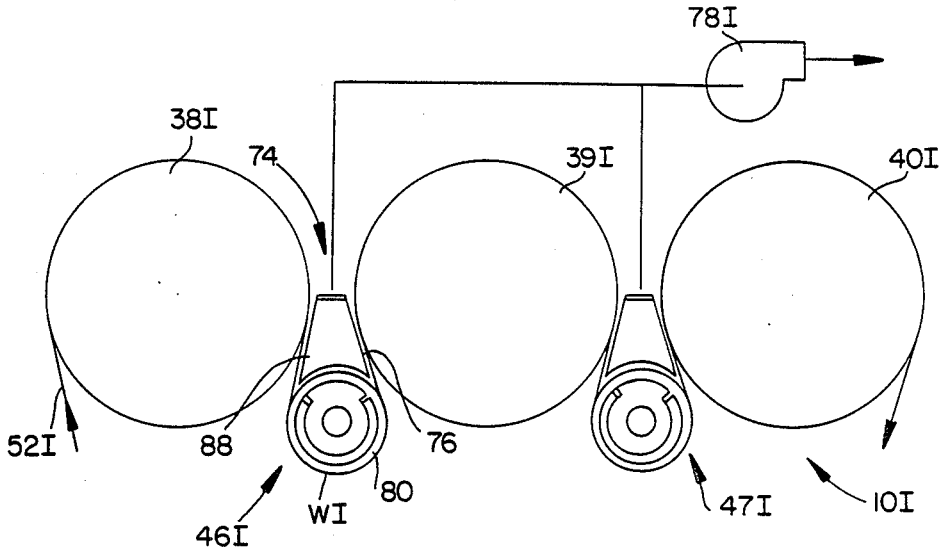
FIG. 11 is a side-elevational view of a dryer apparatus according to the present invention including vacuum rolls and a wedge-shaped box disposed within the pocket.

FIG. 11 is a side-elevational view of a dryer section generally designated 10I according to the present invention. The dryer section 10I includes dryers 38I, 39I and 40I and transfer means generally designated 46I disposed between the dryers 38I and 39I respectively. Sealing means generally designated 74 are disposed within a pocket 76 defined by a dryer felt 52I extending between the dryers 38I and 39I and the transfer means 46I. A vacuum fan 78 is connected respectively to the vacuum means 46I and 47I for inducing a flow of air from the pocket 76 into a perforate shell 80 of the transfer means 46I.

Figure 12:
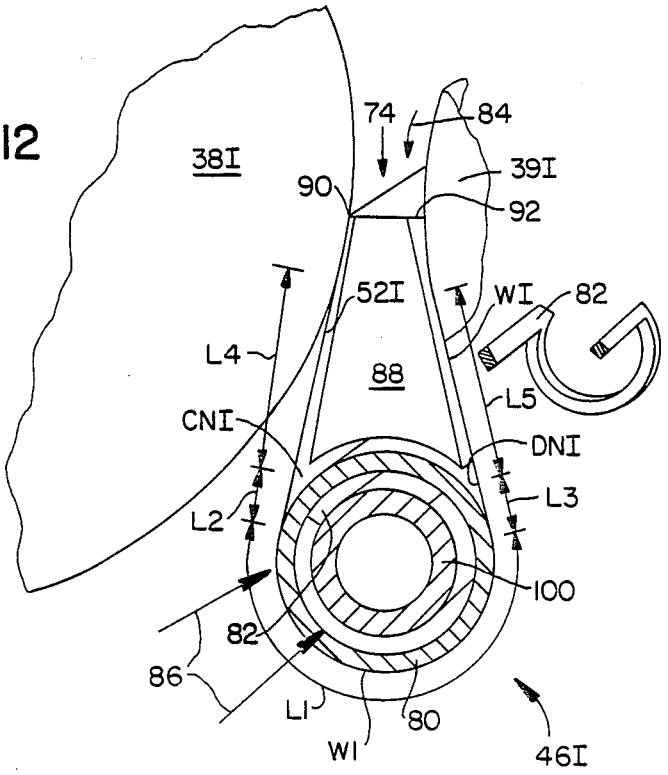
FIG. 12 is an enlarged sectional view of the transfer roll shown in FIG. 12 showing the gasket.

FIG. 12 is an enlarged view of the transfer means 46I showing the perforate roll shell 80 and a gasket 82 which will be described in more detail hereinafter.

As shown in FIG. 12, a critical location indicated by the arrow L1 extends from the converging nip CNI defined between the felt 52I and the shell 80 to the diverging nip DNI defined between the felt 52I and the shell 80. Such critical location L1 according to the present invention is supplied with the greatest vacuum in order to inhibit detachment of the web WI from the felt 52I during movement of the web WI around the transfer roll 46I.

Other critical locations are indicated by the arrows L2 and L3. These locations L2 and L3 are disposed in the vicinity of the converging and diverging nips CNI and DNI respectively. An intermediate vacuum level is applied in these regions L2,L3 according to the provisions of the present invention.

The locations L4 and L5 respectively are provided with minimal vacuum level according to present invention in order to maintain the web WI in close conformity with the felt during transit of the web WI between the dryers 38I and 39I and the transfer roll 46I.

Figure 13:
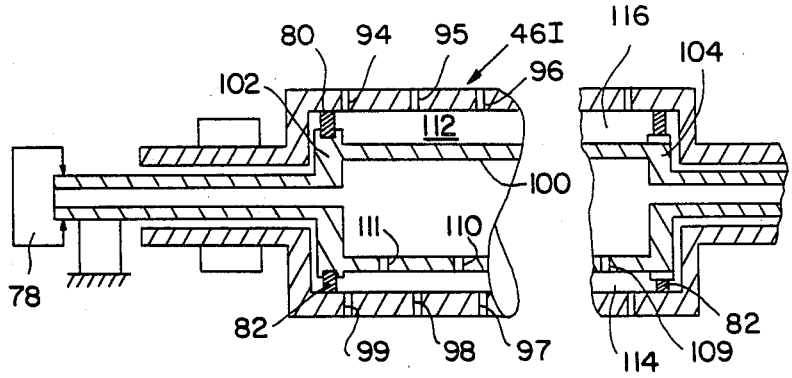
FIG. 13 is a fragmentary sectional view of the transfer roll shown in FIGS. 11 and 12.

FIG. 13 is a fragmentary sectional view of the vacuum transfer roll 46I shown in FIGS. 11 and 12.

More specifically, as shown in FIGS. 11 to 13, a dryer apparatus for drying a web WI extending through a dryer section 10I of a paper machine includes a first dryer 38I of the dryer section 10I. The dryer felt 52I movably extends around the first dryer 38I such that the web WI is disposed between the first dryer 38I and the felt 52I for drying the web WI. A second dryer 39I is disposed downstream relative to the first dryer 38I. The web and the felt WI and 52I respectively extend around the second dryer 39I such that the web WI is disposed between the second dryer 39I and the felt 52I for further drying the web WI. A vacuum transfer means generally designated 46I is disposed downstream relative to the first dryer 38I and upstream relative to the second dryer 39I such that the web WI and the felt 52I extend around the transfer means 46I so that the felt 52I is disposed between the web WI and the transfer means 46I when the web WI and the felt 52I move around the transfer means 46I.

Sealing means generally designated 74 extend between the first and the second dryers 38I and 39I for reducing a flow of air as indicated by the arrow 84 between the first and the second dryers 38I and 39I respectively into a pocket 76 defined by the transfer means 46I and the felt 52I extending between the dryers 38I and 39I and the transfer means 46I.

The transfer means 46I includes a perforate shell 80, the shell 80 being connected to a source of partial vacuum 78 such that in use of the apparatus, a partial vacuum is generated within the shell 80. The partial vacuum induces through the perforate shell 80 a further partial vacuum within the pocket 76 so the air as indicated by the arrow 86 flows in the direction from the web WI towards the felt 52I for urging the web WI into close conformity with the felt 52I during movement of the web WI around the transfer means 46I and also during movement of the web WI between the dryers 38I and 39I and the transfer means 46I.

As shown in FIGS. 11 to 13, the transfer means 46I is a vacuum transfer roll.

The sealing means 74 more specifically includes as shown in FIG. 12 a wedge-shaped box 88 disposed within and conforming to the shape of the pocket 76 such that the further vacuum is induced within the pocket 76 and externally relative to the box 88.

The sealing means 74 also includes a first seal 90 extending from the box 88 with the first seal 90 sealingly cooperating with the felt 52I as the felt 52I moves away from the first dryer 38I.

A second seal 92 extends from the box 88 with the second seal 92 sealingly cooperating with the felt 52I as the felt 52I begins to move around the second dryer 39I. The seals 90 and 92 maintain the further partial vacuum for urging the web WI towards the felt 52I between the dryers 38I and 39I and the transfer means 46I.

As shown particularly in FIG. 13, the perforate shell 80 is rotatably connected to the source of partial vacuum 78 and defines a plurality of perforations 94, 95, 96, 97, 98 and 99.

The transfer roll 46I also includes as particularly shown in FIG. 13 a stationary duct 100 having a first and a second end 102 and 104 respectively. The duct 100 is disposed within the rotatable shell 80 and defines a plurality of apertures 109, 110 and 111 between the first and second ends 102 and 104 of the duct 100.

The duct 100 is connected to the source of partial vacuum 78 such that in use of the apparatus, the partial vacuum within the duct 100 generates the partial vacuum within a cavity 112 defined between the shell 80 and the duct 100.

As shown in FIGS. 11 to 13, the transfer roll 46I includes a gasket 82 which extends from the duct 100 to the shell 80 for dividing the cavity 112 into a first and a second portion 114 and 116 respectively. The first portion 114 is disposed adjacent to the felt 52I and the web WI as the felt and web 52I and WI respectively extend around the transfer roll 46I.

The gasket 82 extends partially around the duct 100 adjacent to the first and second ends 102 and 104 respectively of the duct 100. The gasket 82 extends from a first angular location L2 disposed upstream relative to the convergence CNI of the felt 52I and the transfer roll 46I to a second angular location L3 disposed downstream relative to the divergence DNI of the felt 52I and the transfer roll 46I. The gasket 82 extends axially along the first location L2 from the first end 102 to the second end 104 of the duct 100. The gasket 82 also extends axially along the second location L3 from the first end 102 to the second end 104 of the duct 100 such that in use of the apparatus, a maximum vacuum level is maintained within the first portion 114, a minimum vacuum level is maintained within the pocket 76 and an intermediate vacuum level is maintained within the second portion 116 which is disposed adjacent to the converging and diverging nips. The arrangement is such that the maximum vacuum level maintains the web WI in close conformity with the felt 52I as the web and felt extend around the transfer roll 46I. The intermediate vacuum level is operative adjacent to the convergence CNI and divergence DNI of the felt 52I relative to the transfer roll 46I. The minimum vacuum level is operative for urging the web WI towards the felt 52I during movement of the web WI between the dryers 38I and 39I and the transfer roll 46I.

Figure 14:
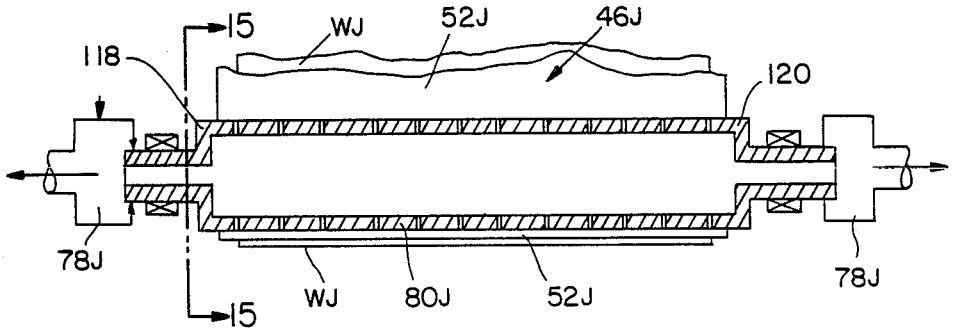
FIG. 14 is a sectional view of a further embodiment of the present invention.
Figure 15:
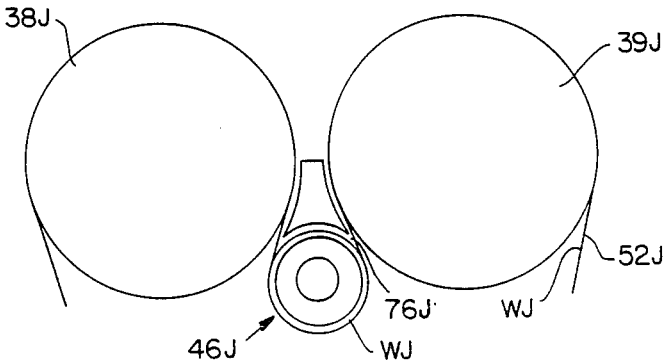
FIG. 15 is a sectional view taken on the line 15—15 of FIG. 15.

FIG. 14 shows a further embodiment of the present invention in which a transfer roll generally designated 46J includes a roll shell 80J which is perforate along the axial length thereof. A source of vacuum 78J is rotatably connected to the first and second extremities 118 and 120 of the shell 80J. Vacuum is applied such that a maximum vacuum is maintained within the shell 80J for urging the web WJ into close conformity with the felt 52J as the web WJ extends around the shell 80J as shown in FIG. 15. A minimum vacuum will be induced in the pocket 76J for drawing the web WJ into conformity with the felt 52J during transit of the web between the dryers 38J and 39J and the transfer roll 46J.

Figure 16:
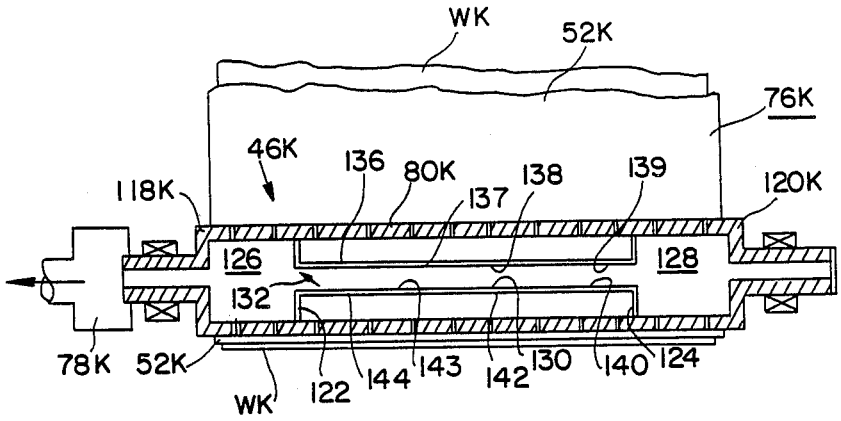
FIG. 16 is a sectional view of yet another embodiment of the present invention including a first and second baffle.

FIG. 16 is a sectional view of a further embodiment of the present invention and shows a transfer roll generally designated 46K. The transfer roll 46K includes a perforate shell 80K having a first and second extremity 118K and 120K. The shell 80K also includes first and second baffles 122 and 124 respectively disposed axially relative to each other within the perforate shell 80K for defining a first and second chamber 126 and 128 within the perforate shell 80K. The first and second chambers 126 and 128 are disposed respectively adjacent to the first and second extremities 118K and 120K of the perforate shell 80K.

An air flow conduit 130 extends from the first baffle 122 to the second baffle 124 such that the first and second chambers 126 and 128 are in fluid communication with each other.

Valve means 132 is disposed within the conduit 130 for regulating the flow of air within the conduit 130 between the first and second chambers 126 and 128.

An intermediate chamber 134 is defined by the perforate shell 80K, the baffles 122 and 124 respectively and the conduit 130. The conduit 130 defines a plurality of holes 136, 137, 138, 139, 140, 141, 142, 143 and 144 for permitting flow of air from within the intermediate chamber 134 into the conduit 130 such that in use of the apparatus, when the extremity 118K of the perforate shell 80K is connected to a source of partial vacuum 78K and when the valve means 132 is closed, the greatest vacuum is generated within the first chamber 126 for facilitating threading of a tail (not shown) of the web. When the valve means 132 is open, an equal vacuum is generated within the first and second chambers 126 and 128 respectively for urging the lateral edges of the web WK into close conformity with the felt 52K as the web WK and felt 52K extend around the transfer roll 46K. The equal vacuum is less than the greatest vacuum. Furthermore, the partial vacuum induces a minimal vacuum level within the intermediate chamber 134 for generating a minimal vacuum within the pocket 76K above the transfer roll 46K.

Figure 17:
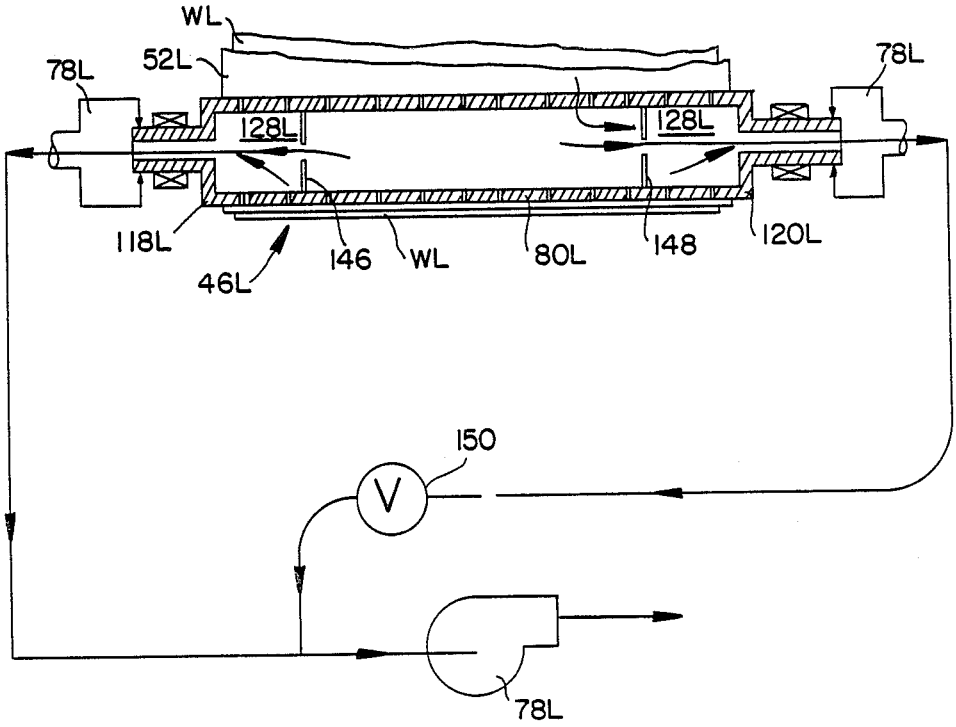
FIG. 17 is a sectional view of a transfer roll according to a further embodiment of the present invention including a first and second orifice plate.

FIG. 17 is a sectional view of yet a further embodiment of the present invention and shows a vacuum transfer roll generally designated 46L. The roll 46L includes a perforate shell 80L having first and second extremities 118L and 120L which are connected respectively to a source of partial vacuum 78L. The transfer roll 46L also includes a first and second orifice plate 146 and 148 respectively. The plates 146 and 148 are spaced axially relative to each other within the perforate shell 80L for defining a threading cavity 126L and an edge cavity 128L.

A control valve 150 controls the flow of air from the edge cavity 128L such that when the control valve 150 is closed, air flows into the perforate shell 80L with a high vacuum being generated within the threading chamber 126L due to the first orifice plate 146 for facilitating threading of a tail (not shown) of the web WL.

When the control valve 150 is open, air flows into the perforate shell 80L generating an intermediate vacuum within the threading chamber 126L and the edge chamber 128L. The intermediate vacuum is higher than the vacuum within the perforate shell 80L between the orifice plates 146 and 148 respectively due to the provision of the orifice plates so that fluttering of the edges of the web WL relative to the felt 52L as the web extends around the transfer roll 46L is inhibited due to the intermediate vacuum. The intermediate vacuum is less than the high vacuum.

In operation of the apparatus shown in FIGS. 11 to 13, partial vacuum is applied to the duct 100 which induces a maximum vacuum level within the portion 114 and an intermediate vacuum within the portion 116. The maximum vacuum is applied along the location L1 shown in FIG. 12 where there exists the greatest tendency for the web to move away from the felt.

The intermediate vacuum within portion 116 is operative particularly along the locations L2 and L3 as shown in FIG. 12 which is a potentially critical area as typically due to the pumping effect of the felt relative to the transfer roll, the web has a tendency to be blown away at this location L2 from the supporting felt.

A minimum vacuum level is maintained within the pocket above the transfer roll such that in the location L4 and L5 as shown in FIG. 12, the tendency of the web to flutter relative to the felt is inhibited.

In operation of the embodiment shown in FIGS. 14 and 15, the partial vacuum is applied to the shell so that the highest vacuum is operative in the critical location L1 shown in FIG. 12 and a minimal vacuum level is operative within the pocket above the transfer roll.

In operation of the embodiment shown in FIG. 16, when the valve 132 is closed, a high vacuum is induced within the compartment 126 for facilitating threading of a tail.

Once the web has been threaded through the drying section, the valve 132 is opened thereby applying equal vacuum within the chambers 126 and 128 for urging the lateral edges of the web into close conformity with the felt.

A lesser vacuum level is attained within the intermediate chamber 134 by the provision of appropriately sized apertures defined by and along the intervening conduit. Such lower vacuum level is operative within the pocket above the roll for maintaining the web in conformity with the felt during transit of the web between the dryers and the transfer roll.

In operation of the embodiment shown in FIG. 17, when the valve is closed, the greatest vacuum level will be attained in compartment 126L for assisting threading of a tail.

Once the tail has been threaded through the dryer section, the valve 150 is opened and an equal vacuum will be attained in compartments 126L and 128L thereby maintaining the edges of the web in close conformity with the felt during operation of the drying section.

Due to the provision of the orifice plates 146 and 148, a lower vacuum level will be operative within the pocket above the transfer roll for urging the web into conformity with the felt as in the previous embodiments.

The present invention provides a relatively simple and low-cost means for positively restraining the web during transit between successive dryers and also facilitates threading of a tail of the web.

What is claimed is:

1. A dryer apparatus for drying a web extending through a dryer section of a paper machine, said apparatus comprising;

a first dryer of the dryer section;

a dryer felt movably extending around said first dryer such that the web is disposed between said first dryer and said felt for drying the web;

a second dryer disposed downstream relative to said first dryer, the web and said felt extending around said second dryer such that the web is disposed between said second dryer and said felt for further drying of the web;

a vacuum transfer roll disposed downstream relative to said first dryer and upstream relative to said second dryer such that the web and said felt extend around said transfer roll so that said felt is disposed between the web and said transfer roll when the web and said felt move around said transfer roll;

sealing means extending between said first and second dryers for reducing a flow of air between said first and second dryers into a pocket defined by said transfer roll and said felt extending between said dryers and said transfer roll;

said transfer roll including:

a perforate shell, said shell being connected to a source of partial vacuum such that in use of the apparatus, a partial vacuum is generated within said shell, said partial vacuum inducing through said perforate shell a further partial vacuum within said pocket so that air flows in a direction from the web towards said felt for urging the web into close conformity with said felt during movement of the web around said transfer roll and also during movement of the web between said dryers and said transfer roll; and said sealing means further including:

a wedge-shaped box disposed within and conforming to the shape of said pocket such that said further vacuum is induced within said pocket and externally relative to said box.

2. A dryer apparatus as set forth in claim 1 wherein said sealing means further includes:

a first seal extending from said box, said first seal sealingly cooperating with said felt as said belt moves away from said first dryer;

said seal maintaining said further partial vacuum for urging the web towards said felt between said dryers and said transfer roll.

3. A dryer apparatus as set forth in claim 1 wherein said perforate shell is rotatably connected to said source of partial vacuum.

4. A dryer apparatus as set forth in claim 3 wherein said transfer roll further includes:

a stationary duct having a first and a second end, said duct being disposed within said rotatable shell, said duct defining a plurality of apertures between said first and second ends thereof;

said duct being connected to said source of partial vacuum such that in use of the apparatus, said partial vacuum within said duct generates said partial vacuum within a cavity defined between said shell and said duct.

5. A dryer apparatus for drying a web extending through a dryer section of a paper machine, said apparatus comprising:

a first dryer of the dryer section;

a dryer felt movably extending around said first dryer such that the web is disposed between said first dryer and said felt for drying the web;

a second dryer disposed downstream relative to said first dryer, the web and said felt extending around said second dryer such that the web is disposed between said second dryer and said felt for further drying the web;

vacuum transfer means disposed downstream relative to said first dryer and upstream relative to said second dryer such that the web and said felt extend around said transfer means so that said felt is disposed between the web and said transfer means when the web and said felt move around said transfer means;

said transfer means being a vacuum transfer roll;

sealing means extending between said first and second dryers for reducing a flow of air between said first and second dryers into a pocket defined by said transfer means and said felt extending between said dryers and said transfer means;

said transfer means including:

a perforate shell, said shell being connected to a source of partial vacuum such that in use of the apparatus, a partial vacuum is generated within said shell, said partial vacuum inducing through said perforate shell a further partial vacuum within said pocket so that air flows in a direction from the web towards said felt for urging the web into close conformity with said felt during movement of the web around said transfer means and also during movement of the web between said dryers and said transfer means;

said perforate shell being rotatably connected to said source of partial vacuum;

said transfer roll further including: a stationary duct having a first and a second end, said duct being disposed within said rotatable shell, said cut defining a plurality of apertures between said first and second ends thereof;

said duct being connected to said source of partial vacuum such that in use of the apparatus, said partial vacuum within said duct generates said partial vacuum within a cavity defined between said shell and said duct; and a gasket extending from said duct to said shell for dividing said cavity into a first and a second portion, said first portion being disposed adjacent to said felt and the web as said felt and the web extend around said transfer roll.

6. A dryer apparatus as set forth in claim 5 wherein said gasket extends partially around said duct adjacent to said first and second ends of said duct, said gasket extending from a first angular location disposed upstream relative to the convergence of said felt and said transfer roll to a second angular location disposed downstream relative to the divergence of said felt and said transfer roll, said gasket extending axially along said first location from said first to said second end of said duct, said gasket also extending axially along said second location from said first to said second end of said duct such that in use of the apparatus a maximum vacuum level is maintained within said first portion, a minimum vacuum level is maintained within said pocket and an intermediate vacuum level is maintained within said second portion which is disposed towards said pocket, the arrangement being such that said maximum vacuum level maintains the web in close conformity with said felt as the web and said felt extend around said transfer roll, said intermediate vacuum level is operative adjacent said convergence and said divergence of said felt relative to said transfer roll, and said minimum vacuum level is operative for urging the web towards said felt during movement of the web between said dryers and said transfer roll.

7. A dryer apparatus for drying a web extending through a dryer section of the papermachine, said apparatus comprising:

a first dryer of the dryer section;

a dryer felt movably extending around said first dryer such that the web is disposed between said first dryer and said felt for drying the web;

a second dryer disposed downstream relative to said first dryer, the web and said felt extending around said second dryer such that the web is disposed between said second dryer and said felt for further drying the web;

vacuum transfer means disposed downstream relative to said first dryer and upstream relative to said second dryer such that the web and said felt extend around said transfer means so that said felt is disposed between the web and said transfer means when the web and said felt move around said transfer means;

said transfer means including:

a perforate shell, said shell being connected to a source of partial vacuum such that in use of the apparatus, a partial vacuum is generated within said shell, said partial vacuum inducing through said perforate shell a further partial vacuum within said pocket so that air flows in a direction from the web towards said felt for urging the web into close conformity with said felt during movement of the web around said transfer means and also during movement of the web between said dryers and said transfer means;

said transfer means being a vacuum transfer roll;

said perforate shell being rotatably connected to said source of partial vacuum;

said shell having a first and second extremity, said shell further including:

first and second baffles disposed axially relative to each other within said perforate shell for defining a first and second chamber within said perforate shell, said first and second chambers being disposed respectively adjacent to said first and said second extremities of said perforate shell;

an air flow conduit extending from said first to said second baffle such that said first and second chambers are in fluid communication with each other;

valve means disposed within said conduit for regulating the flow of air within said conduit between said first and second chambers;

an intermediate chamber defined by said perforate shell, said baffles and said conduit; and said conduit defining a plurality of holes for permitting flow of air from within said intermediate chamber into said conduit such that in use of the apparatus, when said perforate shell is connected to said source of partial vacuum and when said valve means is closed, the greatest vacuum is generated within said first chamber for facilitating threading of a tail of the web and when said valve means is open, an equal vacuum is generated within said first and second chambers for urging the laterally edges of the web into close conformity with said felt as the web and felt extend around said transfer roll, said equal vacuum being less than said greatest vacuum and also for generating a minimal vacuum level within said intermediate chamber for generating a minimal vacuum within said pocket.

8. A dryer apparatus for drying a web extending through a dryer section of a papermachine, said apparatus comprising:

a first dryer of the dryer section;

a dryer felt movably extending around said first dryer such that the web is disposed between first dryer and said felt for drying the web;

a second dryer disposed downstream relative to said first dryer, the web and said felt extending around said second dryer such that the web is disposed between said second dryer and said felt for further drying the web;

vacuum transfer means disposed downstream relative to said first dryer and upstream relative to said second dryer such that the web and said felt extend around said transfer means so that said felt is disposed between the web and said transfer means when the web and said felt move around said transfer means;

said transfer means including: a perforate shell, said shell being connected to a source of partial vacuum such that in use of the apparatus, a partial vacuum is generated within said shell, said partial vacuum inducing through said perforate shell a further partial vacuum within said pocket so that air flows in a direction from the web towards said felt for urging the web into close conformity with said felt during movement of the web around said transfer means and also during movement of the web between said dryers and said transfer means;

said transfer means being a vacuum transfer roll;

said perforate shell being rotatably connected to said source of partial vacuum;

said shell having a first and a second extremity, said extremities of said shell being connected respectively to a source of partial vacuum;

said transfer roll further including:

a first and second orifice plate, said first and second orifice plates being spaced axially relative to each other within said perforate shell for defining a threading cavity and an edge cavity; and a control valve for controlling the flow of air from said edge cavity such that when said control valve is closed, air flows into said perforate shell with a high vacuum being generated within said threading cavity due to the first orifice plate for facilitating threading of a tail of the web and when the control valve is open, air flows into said perforate shell generating an intermediate vacuum within said threading cavity and said edge cavity said intermediate vacuum being higher than the vacuum within said perforate shell between said orifice plates due to the provision of said orifice plates so that fluttering of the edges of the web relative to the felt as the web extends around the transfer roll is inhibited due to said intermediate vacuum, said intermediate vacuum being less than said high vacuum.

* * * * *

UNITED STATES PATENT AND TRADEMARK OFFICE

CERTIFICATE OF CORRECTION

PATENT NO. : 4,876,803

DATED : 10/31/89

INVENTOR(S) : Gregory L. Wedel

It is certified that error appears in the above—identified patent and that said Letters Patent is hereby corrected as shown below:

Column 12: line 50, delete "belt" and insert therefor --felt--.

Signed and Sealed this

Eighth Day of January, 1991

*Attest:*

HARRY F. MANBECK, JR.

*Attesting Officer*

*Commissioner of Patents and Trademarks*